US005338067A

United States Patent [19]

Gundjian

[11] Patent Number: 5,338,067

[45] Date of Patent: Aug. 16, 1994

[54] SWITCHON-SWITCHOFF, MULTISTATE, INTERACTIVE, ANTIPHOTOCOPYING ANTIFRAUD AND ANTIFAXING SYSTEM

[75] Inventor: Arshevir Gundjian, Montreal, Canada

[73] Assignee: Nocopi International Ltd., Montreal, Canada

[21] Appl. No.: 941,031

[22] PCT Filed: Mar. 28, 1991

[86] PCT No.: PCT/CA91/00101

§ 371 Date: Oct. 1, 1992

§ 102(e) Date: Oct. 1, 1992

[87] PCT Pub. No.: WO91/15805

PCT Pub. Date: Oct. 17, 1991

[30] Foreign Application Priority Data

Apr. 2, 1990 [GB] United Kingdom ..... 9007387

[51] Int. Cl.[5] ..... B42D 15/00

[52] U.S. Cl. ..... 283/67; 283/902

[58] Field of Search ..... 283/67, 902

[56] References Cited

U.S. PATENT DOCUMENTS 3,276,869 10/1966 McCune, Jr. ..... 96/3

3,427,160 2/1969 McCune, Jr. ..... 96/29

3,468,662 9/1969 McCune, Jr. ..... 96/77

4,137,194 1/1979 McCure, Jr. ..... 252/316

5,060,981 10/1991 Fossum et al. ..... 283/91

FOREIGN PATENT DOCUMENTS 302774 2/1959 European Pat. Off. .

*Primary Examiner*—Paul A. Bell

*Attorney, Agent, or Firm*—Sprung Horn Kramer & Woods

[57] ABSTRACT

A method and apparatus for preventing reproduction of printed matter on a substrate by photocopying, telefaxing and the like. A substrate is provided with at least one main surface and a photochromic dye is applied to the one main surface, wherein the dye changes color in response to exposure to light with a response time which is a function of the amount of light absorbed by the dye in a given time period. The one main surface is illuminated with a given amount of light and the response time is decreased to accelerate the change in color of the dye by increasing the proportion of light which is absorbed by the dye from the given amount of light.

10 Claims, 7 Drawing Sheets

VARIATION OF K AS A FUNCTION OF $n_2$ AND L/d

SWITCHON-SWITCHOFF, MULTISTATE, INTERACTIVE, ANTIPHOTOCOPYING ANTIFRAUD AND ANTIFAXING SYSTEM

BACKGROUND OF THE INVENTION

This invention relates to anti-photocopying and anti-tele-facsimile paper, that is to say, paper which when carrying information in conventional black or similar dark color cannot be readily photocopied or transmitted by telefacsimile in a visually readable manner.

The present day availability of improved photocopiers has increased the problem of rendering documents or portions thereof resistant to photocopying in a readable manner. Anti-photocopying paper which is successful in preventing visually readable photocopying by most present day photocopiers is described in U.S. Pat. No. 4,522,429 (Gardner et al) issued Jun. 11, 1985, U.S. Pat. No. 4,632,429 (Gardner et al) issued Dec. 30, 1986, and U.S. Pat. 4,867,481 (Gundjian) issued Sept. 19, 1989, generally referred to hereinafter as Nocopi technology.

U.S. Pat. No. 4,522,429 teaches the use of anti-photocopying paper having a color with a reflection spectral response of less than about 10% for light with a wavelength below about 600 millimicrons and yet which is sufficiently visually contrasting with information, when such information is typed thereon or otherwise applied thereto, to enable such information to be read by the human eye when the paper is viewed under white light.

U.S. Pat. No. 4,632,429 teaches the use of anti-photocopying paper with a front face having a color with a reflection spectral response which is effectively zero for light with a wavelength below about 625 millimicrons and less than about 1% up to about 1,000 millimicrons so as to render the paper substantially incapable of being photocopied in an information readable manner, after substantially non-translucent information has been typed or otherwise applied to the front face, the paper being capable of transmitting visible light from a rear face to the front face to cause sufficient contrast between the substantially non-translucent information and the transmitted light to enable the information to be read by a human eye viewing the front face of the paper when visible light is transmitted to the paper from the rear face to the front face thereof.

Further improvement in the anti-photocopying and anti-tele-facsimile effect is achieved by the teachings of European patent application 88301745.1, by using spatial spectral modulation of the paper reflectance at a specific single or preferably multiple frequencies.

SUMMARY OF THE INVENTION

The invention of a novel technique is now reported. It consists in the making of a multistate optical characteristic, that translates into a multistate optical density at different optical wavelengths, to be used in the manufacture of anti-photocopying systems. Such systems can be implemented in the form of an ink to be used for example to produce marks with a marker pen on a paper or other substance or in the form of a uniform coating on a portion or the entire surface of a paper or document such that the pen mark or the paper coating will exhibit a variable optical characteristic when exposed to intense illumination.

The invention consists in structuring the optical multistate characteristic device in one of a number of specified ways, such that when applied in conjunction with a paper or any document substrate it will render the combination, resistant to photocopying, telefaxing, or other equivalent means of reproduction. The anti-photocopying system can be designed for an open loop operation in which case it is to be controlled by the user, or for a closed loop, machine operated configuration, where the photocopying light source itself produces the change in the optical characteristic. A basic physical property used in this system is the physical characteristic of certain substances whereby the optical absorption or reflection spectral characteristic of these materials changes dramatically when they are exposed to sufficiently intense (typically optical) radiation at preferred wavelengths. The visual effects of such changes is a change of visible color. Typically certain substances, such as photochromics, will be essentially transparent in their natural state, and will convert into a deep blue color when exposed to long ultraviolet or short wavelength blue radiation. This invention consists particularly in the structuring of specific ink or dye coating systems which allow the system to exhibit the desirable specific variable optical characteristics with specific reduced response times when exposed to the switching activation radiation. The coating system is furthermore physically applied to the substrate with such a specified spatial distribution, that the combination of the spectral, temporal and spatial optical characteristics of the resulting system will make the latter resistant to the photocopying, telefaxing or other types of photoreproduction attempts. The invention thus relates to the selection of the optically active coating system in terms of it's variable optical spectral characteristics, the specified temporal behavior, i.e., the response time to the applied activating light source, and its application with a specific spatial distribution to the paper or any other substrate.

It can be easily visualized that one of the fundamental elements of this invention is the new degree of freedom it introduces to the photocopy prevention problem by completely separating the uncopiability feature from the readability feature of the original document. In all previously available techniques, the latter two features are intimately and inversely coupled together such that a highly uncopiable system also tends to be less and less readable, i.e., less reader friendly.

We shall describe separately the features of this invention that prescribe respectively, the required variable optical characteristic, the response time, and the spatial distribution of the applied coating. When implementing this anti-photocopying invention, ideally all of the above three prescriptions must be respected. Systems with lesser quality, but still adequate for certain uses, will result when one or the other of the above prescriptions is disregarded.

The invention will now be described in more detail with reference to the following description and the attached drawings.

DETAILED DESCRIPTION OF THE INVENTION

I. The Variable Spectral Characteristics of the Coating

The coating can be applied using one of the standard paper coating, inking or printing techniques as well as by dye impregnating the paper pulp. Typically, the composition of the coating may consist of a standard acrylic material or resin in an aqueous, alcohol or hydrocarbon solution such as the Rohm & Haas B66 acroloid solution in toluene to which a combination of dyes is added to produce what we shall label as the "base optical characteristic."

Figure 1:
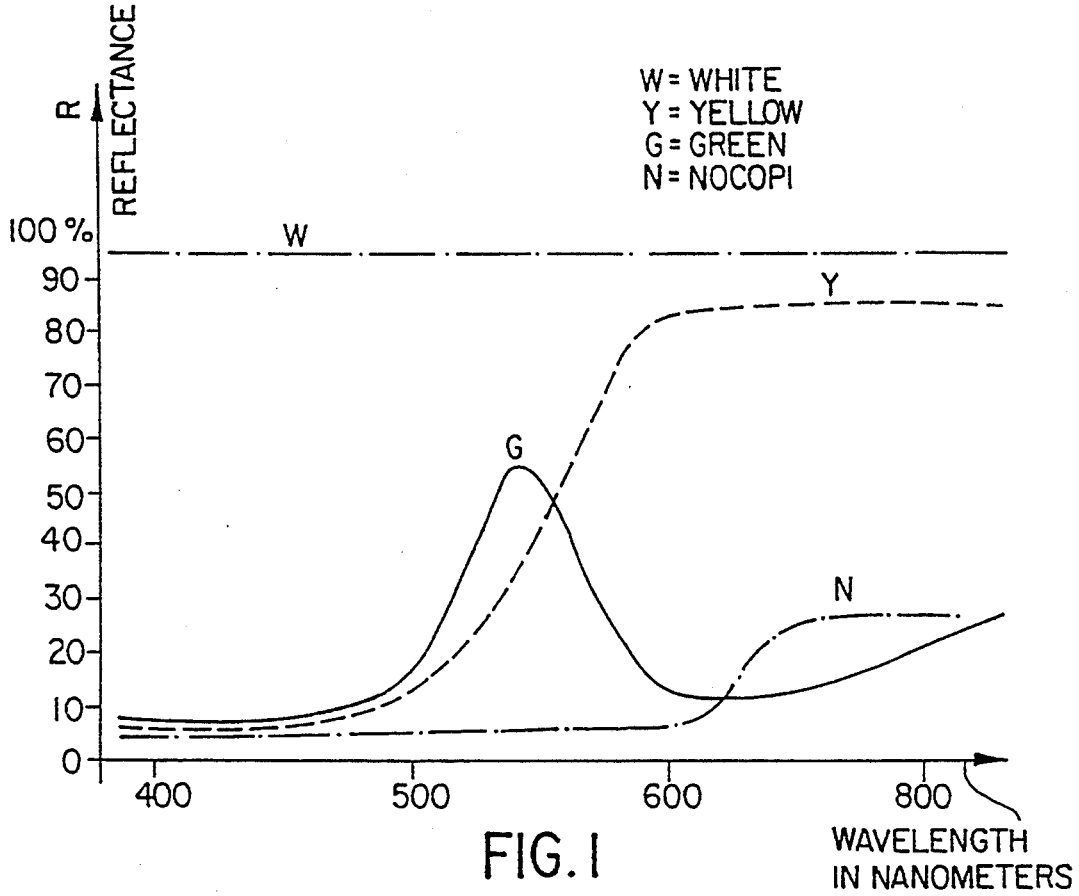
FIG. 1 is a graph of reflectance characteristics according to the invention.

In the wide range of applications, we can contemplate, the base spectral characteristic may consist of any of the following: a colorless i.e., transparent state, a plain white color with a very high reflectivity across the full range of the visible spectrum, or a light color that can be in the blue range with a reflectivity peak at or above 30%, at or above 400 to 500 nanometer wavelength range, or a light color that can be in the yellow range with a reflectivity at or above 30% at and above 560 nanometer wavelength, with a cut-off at and around 560 nanometers, a light color in the range of pink or red with a reflectivity at or above 30% at and above 600 nanometers with a cut-off at and around 600 nanometers, or finally the deep burgundy color more specifically described in the *Nocopi technology,* and whose spectral characteristic is shown in FIG. 1.

Figure 2:
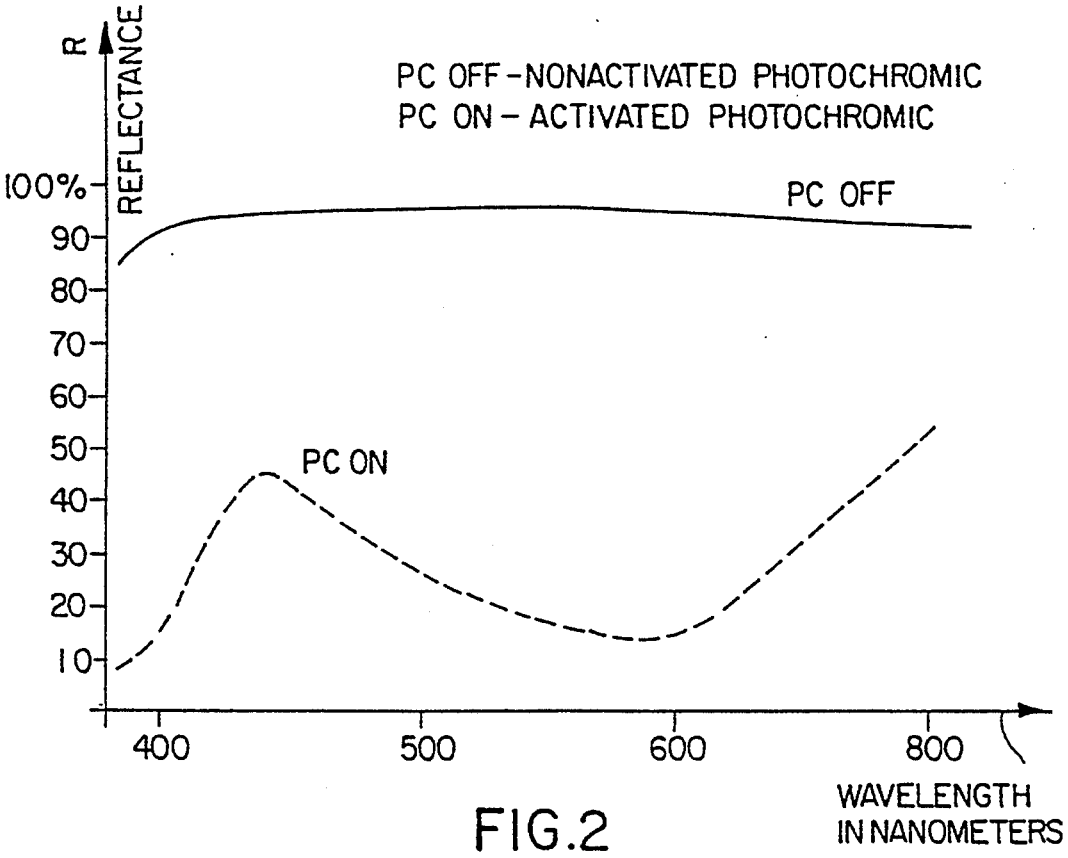
FIG. 2 is a graph of reflectance characteristics of photochromic dyes according to the invention.
Figure 3:
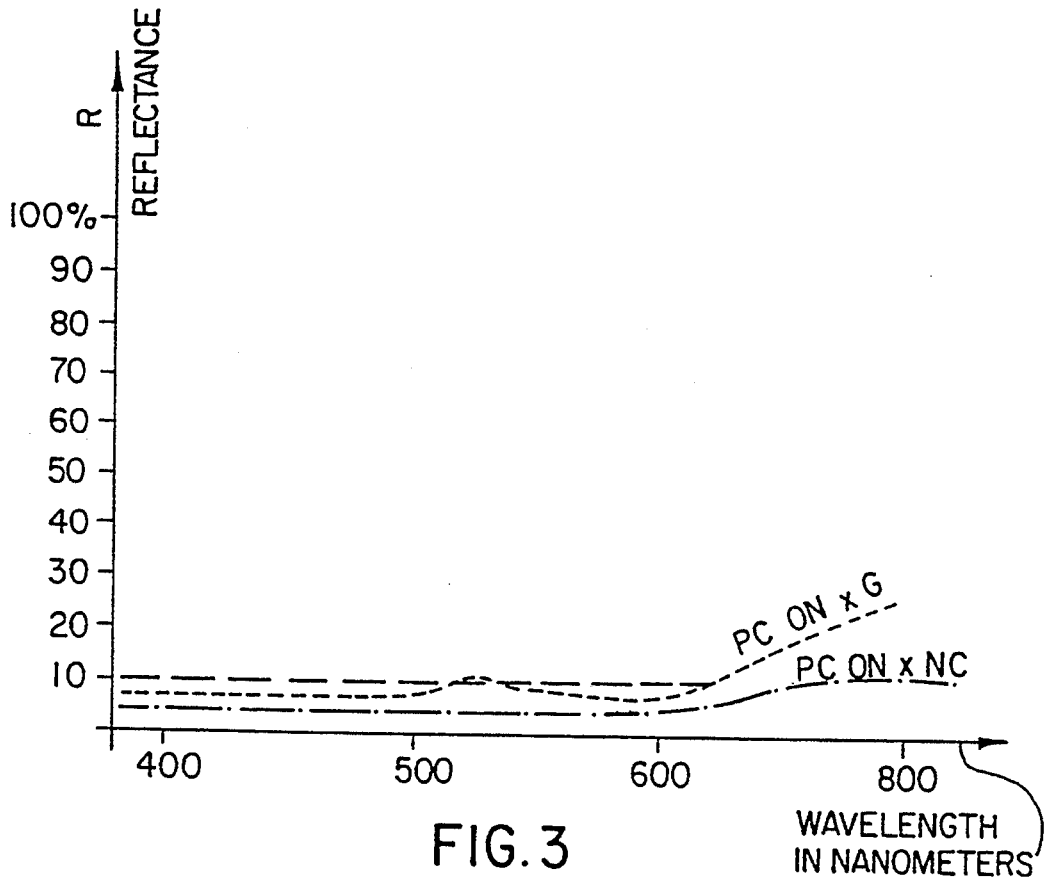
FIG. 3 is a graph of reflectance characteristics of the method and apparatus of the invention.

The other fundamental element that enters into the composition of the coating is the variable optical characteristic dye, typical examples of which is the chromadye 15 or chromadye 2 photochromic dye of Chroma Chemicals Inc. of Dayton, Ohio, in concentrations of the order of 0.5% by weight. The dye can be simply added to the coating compound but an essential feature of this invention is to preferably add the nonlinear dye in a microencapsulated form using technology, which is now well established, in order to allow the use of an optimum solvent structure for the photo-chromic dye that is independent and unaffected by the other components of the coating material. This allows us to tailor the dynamic behavior of the composite coating system both in terms of it's spectral behavior and the response time to an activation source of radiation. The photochromic dyes that are specified to be used in this invention when exposed to the activation light are required to result specifically in a strong absorption band with a broad minimum at around the peak or maximum reflectivity wavelengths of the above mentioned base colors. The absorption minimum is generally expected to extend up to the 600 nanometer range which is shown in FIG. 2. The activated photochromic dyes will modify the previously listed base spectral characteristics in the way of what can be loosely described as the switching on or the addition of a deep blue or more generally a complimentary color which when combined with the base characteristics listed above will make the latter appear respectively as blue, purple, deep brown or black. The full antiphotocopy effect is achieved when the new reflectance shows a very broad minimum extending from below 400 nanometers to around 600 nanometers and limited to a maximum value in the range of 10% or even better 5% as shown in FIG. 3.

Figure 4:
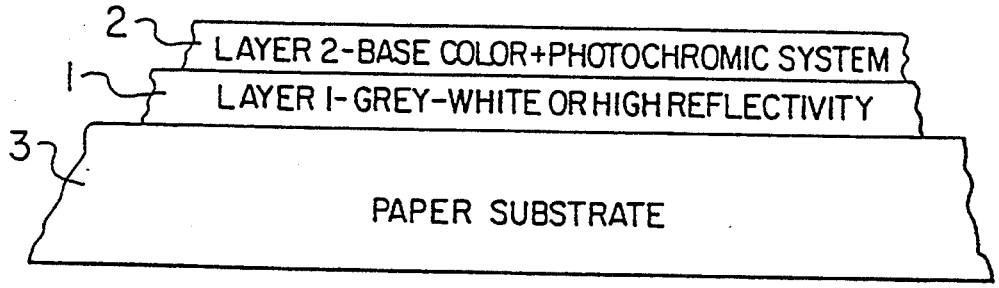
FIG. 4 is a sectional view of one embodiment of the invention.

In one of the practical embodiments of this highly secure anti-photocopy effect, as shown in FIG. 4, the photo-reproduction resistant device is produced using a multi layer structure, where the first or bottom layer 1 on paper substrate 3 exhibits the characteristics prescribed by the *Nocopi technology* and is covered with a top layer 2 which consists of a coating prepared to exhibit one of the "base spectral characteristics" described above. This method of implementation of the invention is, however, overly restrictive and secure. It is, therefore, possible or desirable that the spectral characteristics of the first layer be relaxed to allow a substantially higher reflectivity and, therefore, also substantially higher readability of the unactivated device. When the basic spectral characteristics of the top layer is "transformed" by the activation light source the overall characteristics will fall well within the Nocopi prescription and, therefore, the document will be uncopiable.

The invention can, in the limit, be implemented with the bottom layer having an overall reflectivity across the visible spectrum that is above 15% up to a practically white spectral signature of close to 100% reflectivity. In this case, the most efficient anti-photocopying device will be obtained when the information printed on the double layer is in a color corresponding to the "transformed" spectral characteristics of the photochromic layer such as blue, purple, deep brown or black in the examples cited above but not limited to these colors alone. It is clear that upon activation of the variable spectral characteristic coating, the contrast between the printed information and the background coating will be eliminated and full reproduction will be impossible.

In a preferred embodiment of this invention, the multistate nonlinear optical system is activated at several ultraviolet and visible wavelengths $a_1$, $a_2$, $a_3$ etc. such that a single filter for one of these wavelengths would not be able to neutralize the activation of the device.

II. The Dynamic Behavior of the Variable Optical Characteristic

Many different types of dynamic responses describing the behavior of the variable optical characteristic, under the effect of the activating light source, are made available by the present invention. The activating light can be in the ultraviolet or the visible spectral range, more importantly, the speed of the response can be increased to the milliseconds range and down to several seconds, the intensity of the activation radiation can vary from a very small value to several joules per $cm^2$.

Two basically different modes of operation are considered.

A. The Open Loop or User Controlled Mode of Operation.

In the "open ended" or "user controlled" configuration of this invention the photochromic material is chosen with the broadest freedom of choice insofar as the wavelength, the speed of response and the intensity requirements are concerned. In this configuration it is the user who controls the transformation of the spectral characteristics of the photochromic coating which constitutes the second layer 2 of the two layer scheme introduced previously. The user will switch the variable spectral characteristic coating to the anti-photocopying state by illuminating it outside the photocopier, with an intense light source that provides any desired light intensity levels at the required ultraviolet or visible wavelengths, for the desired length of time (typically tens of seconds), in order for the spectral characteristic to transform to a "dark" state of sufficient optical density where the minimum reflectivity is of the order of 5–10% as described above. When this double layered substrate carrying a printed information as mentioned previously, is used in a photocopying or fax machine, the attempt to obtain a readable copy will fail. This mode of operation is useful when the controlling user, is physically present to make the document unaccessible when the top coating starts to recover its original basic spectral characteristic. The recovery time in this application is preferably as slow as possible, typically of the order of tens of minutes or even several hours.

B. The Closed Loop Operation.

In the closed loop or "machine controlled" configuration, the spectral characteristic transformation takes place under the effect of the machine light source itself. In this configuration the prescription of the invention is to use in the optically active layer, dyes, typically of the spiropyran photochromic family, that respond to long ultraviolet and even better visible wavelength radiation, the chromadye 2 of Chroma Chemicals Inc. is a good example of such a dye.

A vital requirement for the success of this invention in the closed loop mode of operation is, however, the necessity for the optically active dye system to be able to exhibit very short response times, namely of the order of a fraction of a second to a maximum of one second, with switching light energy thresholds of the order of a fraction of a joule/$cm^2$.

Thus a central part of this invention consists of the devices which will carry, contain or surround for example the photochromic dye systems in order to impart to the latter the fast time response and the low switching light intensity thresholds specified above.

It is known that the photochemical interactions which are responsible for the color change phenomena such as photochromism, are inherently very fast and limited only by molecular transition times of less than nanoseconds length. The relaxation processes limit, however, the intensity of the color change thus necessitating long exposure times, which can be ordinarily in the range of tens to hundreds of seconds, in order to achieve the depth of color changes required for the switching of the system to the uncopiable state. Practically, the color switching time can be shortened by increasing the intensity of the activation light. This invention relates, thus, to the development of light intensity enhancement devices which are such that, for a given externally applied activating light intensity, such as the light intensity of the photocopying machine, the actual intensity of the light that impinges on the photochromic dye elements is multiplied several fold, thus accelerating by as much, the color change mechanism. Different acceleration techniques of the photochromic color switching times are listed below. A specific embodiment of this invention may use one of the latter or any number of them in combination in order to increase the speed of response to the level required in a given application.

1. Encapsulated Containment of the Photochromic Dyes: Macrocapsules, Oversized Microcapsules As mentioned before, the photochromic dyes are contained in spherical macrocapsules 10 using a technology similar to that of carbonless paper, as shown in FIG. 5.

The microencapsulation provides, to begin with, the enclosure where the photochromic dye can be maintained in an environment independent of the vehicles that will be used in the printing or coating processes of the dye. The photochromic dyes will prefer controlled environments such as Toluene, Cellulose acetates or others, to exhibit intrinsically faster response times and well defined spectral characteristics. While encapsulation for this latter purpose alone will require typical microcapsule dimensions of the order of 5 microns, in the present invention the preferred dimensions is distinctly larger and in the 10 to 25 and even 50 micron range. We shall call these structures macrocapsules in comparison with the usual microcapsule dimension.

Figure 5:
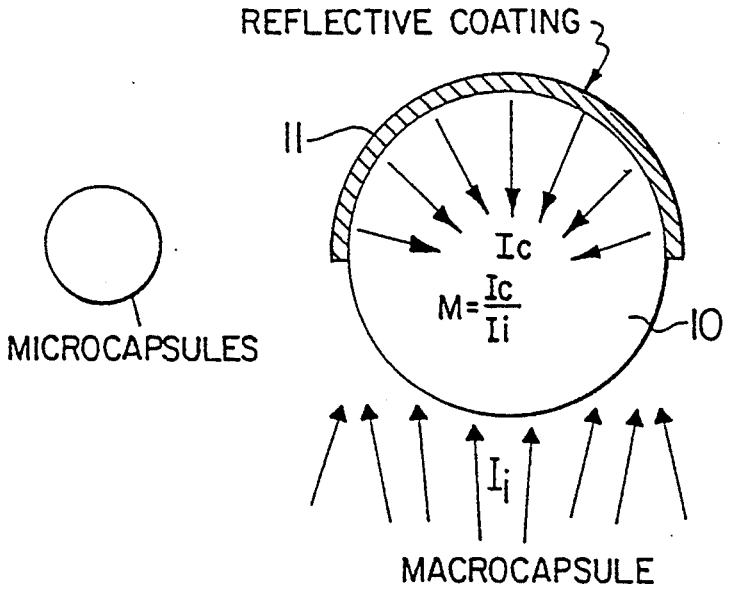
FIG. 5 shows another embodiment of the invention.

The macrocapsules 10 are now utilized as light accumulating elements as shown in FIG. 5.

A fraction of the external surface of the macrocapsule sphere is covered with a reflecting coating 11. This can be achieved for example by standard evaporation techniques in vacuum. When light is incident on such a macrocapsule from the uncoated direction, clearly a spherical mirror effect will concentrate the light Ic towards the center to an intensity which compared to the incident light intensity Ii will be very large and a function of the diameter of the sphere. As a result, $M=Ic/Ii$ is approximately proportional to the square or the ratio of the diameter to the incident light wavelength. This method of light enhancement can thus provide multiplications of the effective switching light intensity of the order of $M=(D/\lambda)^2$ for $D=25$ microns $\lambda=0.5$ micron $M=2500$ In a practical implementation of this scheme a deterioration of M by one or even two orders of magnitude, will still provide a sizable value of M of about 25 giving a corresponding shortening of the switching time.

Figure 6:
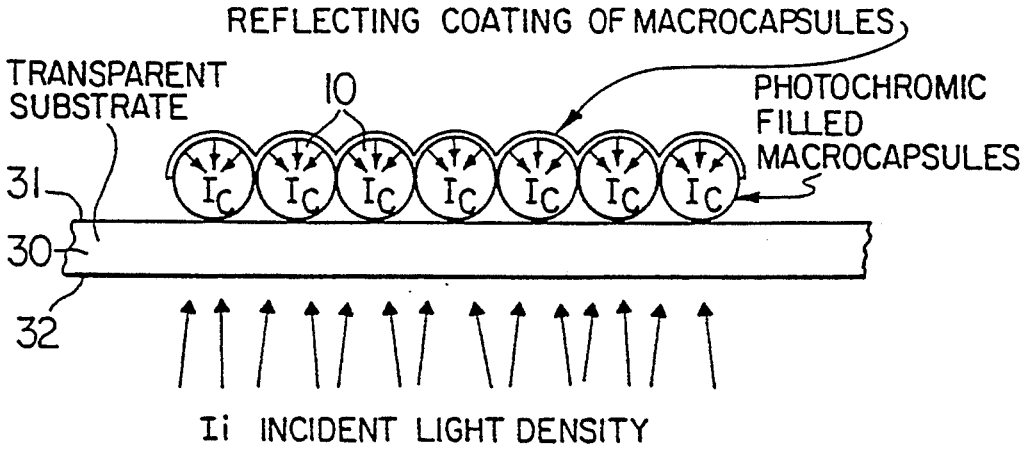
FIG. 6 is a side view of an embodiment using the element of FIG. 5.

FIG. 6 gives an example of a practical embodiment of this technique, where a transparent substrate 30 is first coated from side 31 with the photochromic dye filled macrocapsules 10 having a light metallic reflective coating 11 applied thereafter by evaporation or an equivalent technique such as coating impregnating sputtering, depositing, etc. on these capsules from the same side 31, such that the macrocapsules now become spherical mirrors for light that impinges onto them from side 32 of the substrate which is also the printing, observation and photocopying side of this substrate. It is clear that when the already intense photocopier light is incident from side 32, the focused and further intensified light inuensity Ic will instantly switch the multistate optical characteristic to the dark state and will render the information printed on side 32 uncopiable. On the other hand since the ordinary ambient light used for reading results in a much lesser incident radiation density on side 32, the corresponding focussed light intensities in the macrocapsules will be incapable of producing an appreciable color change in the photochromic coating of the substrate. This requires a scaling of the light enhancement factor M such that for ambient illumination light intensities, the focussed light intensity Ic is approximately 10% of the required fast switching Ic level.

It has been found that a short switch-off time of the photochromic dye is important in a practical embodiment. If the switch-off time is slow, then the darkened dye will slowly become lighter after exposure to an intense light. However, if the substrate is exposed to ambient light, it will become increasingly darker over time and will not go back to its original state, which is undesirable.

In order to obtain the faster switch-off time, the environment of the dye must be controlled. Specifically, the dye is held in the macrocapsule in a liquid solvent which apparently enhances its response time into the off state.

In this regard the following solvents and dyes can be used:

Solvents
Cyclohexane
Hexane
Dibasic Acid Ester (DBE by Dupont)
Dibutyl Phthalate
Diethyl Acetate
Dytek-A (Dupont)
KMC-113; Di-isopropyl Naphthelene
Toluene
Xylene
n-Butyl Benzoate
Acetophenone
Cyclohexanone
Mineral Oil
Trichloro Benzene
Trimethyl Benzene Dyes (Chromadyes from Chroma Chemical)

| | | | |
|---|---|---|---|
| C-1 | C-2 | C-5 | C-15 |
| C-18 | C-19 | C-20 | C-38 |
| C-39 | C-43 | C-44 | C-52 |
| C-55 | | | |

2. Quasi Fabry Perot Structure

Figure 7A:
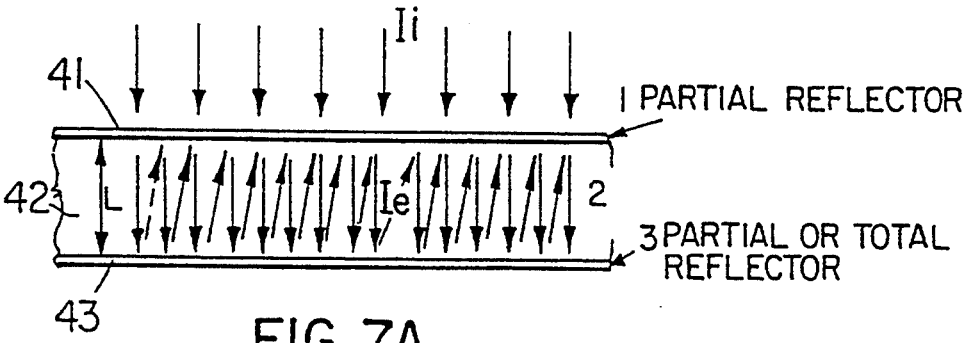
FIGS. 7A and 7B shows another embodiment of the invention.

A Fabry Perot structure in optical terminology generally consists of two face to face partially reflective surfaces separated by a distance L. FIG. 7A shows the configuration which is utilized to contain the optically active coating described in section I, labelled as component 42; the components 41 and 43 consist of partially reflective coatings which are thus separated by the thickness L of the component 42.

The basic feature of this structure consists in the dramatic build up of radiation intensities inside the region 42 to a level Ie, when it is exposed to an incident radiation of intensity Ii. This is due to the multiple reflections between reflectors 41 and 42 which trap the radiation inside the component 42. This is a well known feature of a Fabry Perot structure where the enhancement ratio $$F = \frac{Ie}{Ii}$$

can reach several orders of magnitude depending on the Ii incidence angle and the reflectivities of components 41 and 43 in FIG. 7A.

Since the actual enhancement ratio required is generally appreciably less, and of the order of a factor 25, a degradation of the factor F due to such parameter variations as random angle of incidence of Ii on the Fabry Perot structure, imperfections in either reflectors 41 and and others will still provide the necessary magnitude of F and correspondingly the necessary acceleration of the optical switching.

Figure 7B:
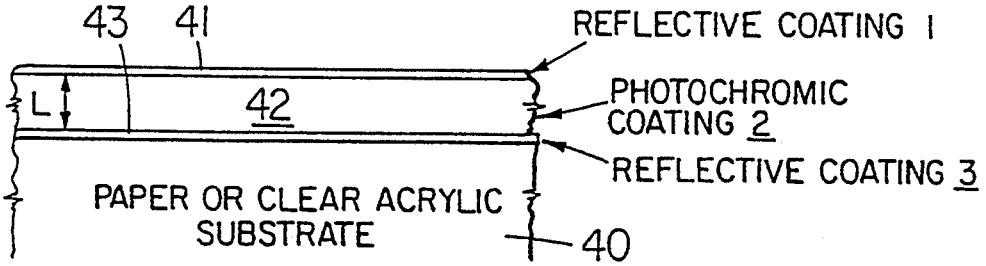

The practical embodiment of this structure is obtained as shown in FIG. 7B. A paper or clear acrylic substrate 40 is first coated by light metalization with the reflective coating 43, in a second step the photochromic active coating 42 of thickness L is applied, where typically values of L can be in the 25 to 50 microns range and finally the second reflective coating 41 is applied through a last step of light metalization. The Fabry Perot light enhancement and switching acceleration scheme is used in conjunction with a paper substrate when making antiphotocopying papers, it is also most conveniently used in conjunction with the clear acrylic substrate of a self adhesive tape, in which case the tape is utilized as an anti-photocopying device that can be applied on selected parts of a document.

3. Radiation Density Enhancement by Propagation Cross Section Transformation

Figure 8A:
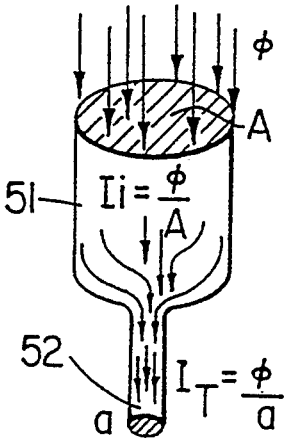
FIGS. 8A and 8B shows a still further embodiment of the invention.
Figure 8B:
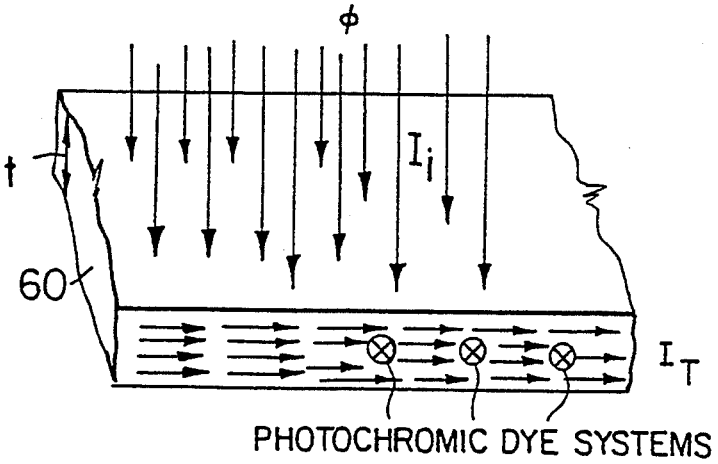

The basic concept of this technique is illustrated in FIG. 8A which shows a total flux propagating in a guide 51 of crossectional area A, which is then transferred to a guide 52 of smaller crossectional area a. It is shown that the radiation density at A is equal to $Ii=\phi/A$, while at a the density is $I_T=\phi/a$ The radiation density is thus intensified by a transformation factor $K=I_t/Ii=A/a$ This concept is now transferred to a planar structure as shown in FIG. 8B where the cross sectional area transformation and the corresponding light radiation density transformation is obtained by diverting the flux of light incident normally, on the surface of the planar sheet or film as shown in FIG. 8B to propagate inside the sheet or film 60 of thickness t in a direction parallel to the surface of the sheet which acts as an optical guide. It can be easily shown that the optical radiation density enhancement thus obtained $K=I_T/Ii$ is proportional to $1/t$ As a result, the sheet or film acts like a thin film light intensifier (TFLI).

In typical embodiments of this technique the planar sheet of FIG. 8B constitutes the coating of an antiphotocopying paper sheet, or the coating of a clear acrylic self-adhesive tape. Since t is normally very small, typically of the order of a few microns, K can be made very large. The photochromically active dye systems, which are for example, microencapsulated as described in section I-1, are implanted within the coating thickness t. They are therefore, subjected to the enhanced light intensity $I_T$ and therefore, their conversion or switching to the dark state is correspondingly accelerated. The diversion of the light propagation direction from the normal to the sheet surface to the direction parallel to the sheet surface, inside the thickness of the latter can be done in a number of different ways as well as by the combination of a few of the latter.

In this invention, the techniques proposed to achieve the diversion of the propagation direction rely on the substantially positive differential of the dielectric coefficient between the light propagating sheet material and free space, together with the inclusion of active or passive light scattering centers throughout the thickness t.

Figure 9:
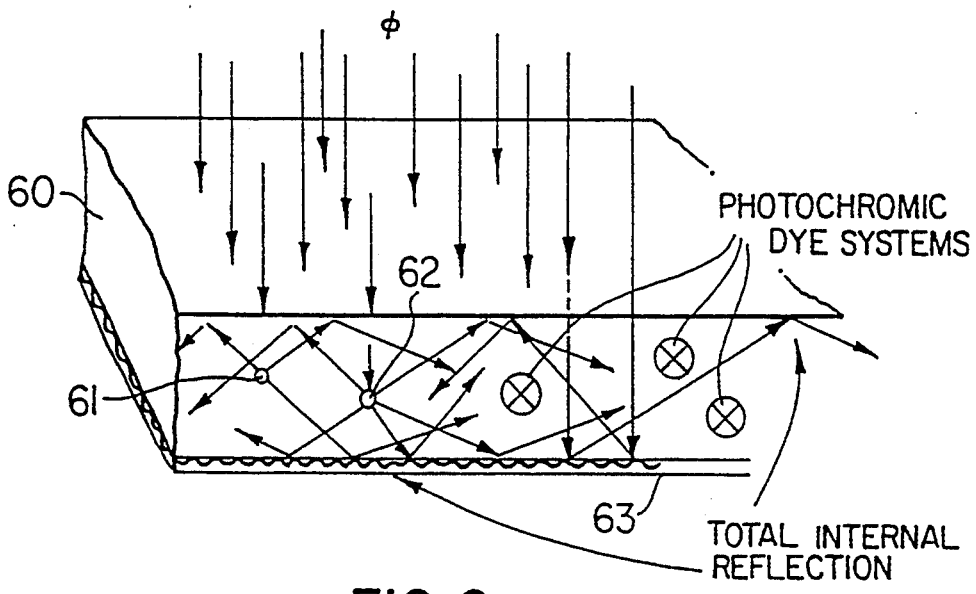
FIG. 9 shows an alternative to the embodiment of FIG. 8.

FIG. 9 shows three types 61, 62, 63 of light scatterers, utilized separately or in combination, in a particular embodiment of the invention. The 61 are passive point scattering centres that are obtained by implanting inside the body of the planar sheet, reflective impurities such as aluminum or other metallic powder seeds.

The scatterers 62 are active point scattering centers that are implemented by introducing in the planar sheet material composition, fluorescent pigments which absorb the incident light in a broad band of wavelengths and re-emit radiation in a narrower band width but omnidirectionally at a longer wavelength.

The scatterer 63 is a microcorrugated reflection surface applied to the bottom face of the planar sheet 60, typically by metalization through vacuum evaporation.

When the externally applied light flux $\phi$, generated typically by the photocopier, hits the top surface of the planar sheet, and penetrates into the latter, the light scattered from any or all of the scatterers 61, 62 and 63 centers, will be mostly trapped within the thickness of the sheet due to the well known affinity for total internal reflection at the interface between the high refractive index planar sheet material and the outside free space as shown in FIG. 9.

FIG. 9 shows the final form of the propagation cross section transformation structure that constitutes the coating of the paper substrate, when the latter is utilized as an antiphotocopying device, or the coating of a self adhesive transparent acrylic tape which can be used to selectively render portions of a sheet of paper, uncopiable.

Figure 10:
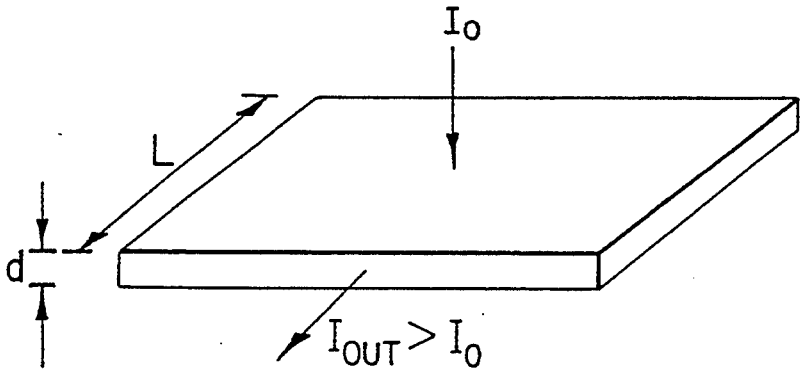
FIG. 10 shows a thin film light intensifier according to the invention.

One can derive a mathematical model of the TFLI. The TFLI is composed of a thin film and the scattering centers (scatterers) that are embedded in the film. If the refractive index of the scattering centers is high enough, the absorption by the scattering centers is small, therefore hopefully most of the incident optical energy can be converted from vertical direction to horizontal direction so that we can obtain high intensity light output (FIG. 10). The critical conditions are $n_1 < n_2 < n_3$ where $n_1$, $n_2$, $n_3$ are refractive indices of the surrounding material, the film and the scattering centers respectively. The scatterer can also be a metallic reflector.

Figure 11:
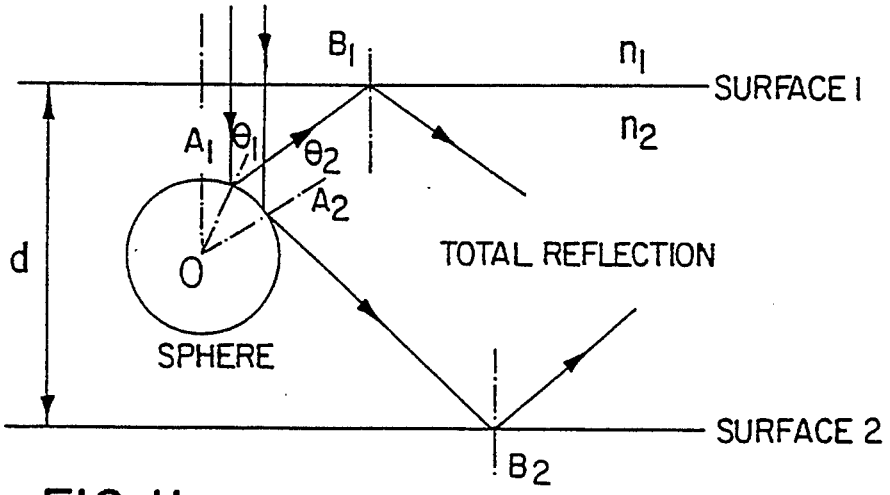
FIG. 11 shows a single scatterer case for the TFLI of FIG. 10.

At first, we discuss the thin film in which there is just one sphere scatterer, as shown in FIG. 11, when the light beam impinges on the thin film, a point $A_1$ can be found from which the reflected beam $A_1B_1$ will be totally reflected on the surface 1. Furthermore, a point $A_2$ can also be found which will lead to total reflection of $A_2B_2$ on the surface 2. Based on this description, the $\theta_1$ and $\theta_2$ can be figured out:

$$\sin 2\theta_1 = \frac{n_1}{n_2} \qquad \theta_1 = \frac{1}{2}\sin^{-1}\left(\frac{n_1}{n_2}\right) \qquad \theta_2 = \frac{\pi}{2} - \theta_1$$

In this case, the light energy impinging on the region $A_1A_2$ will be totally reflected by surfaces 1 and 2 assuming that the sphere's refractive index is so high that no absorption happens on the sphere's surface. The same is true when the sphere is a metallic reflector.

Figure 12:
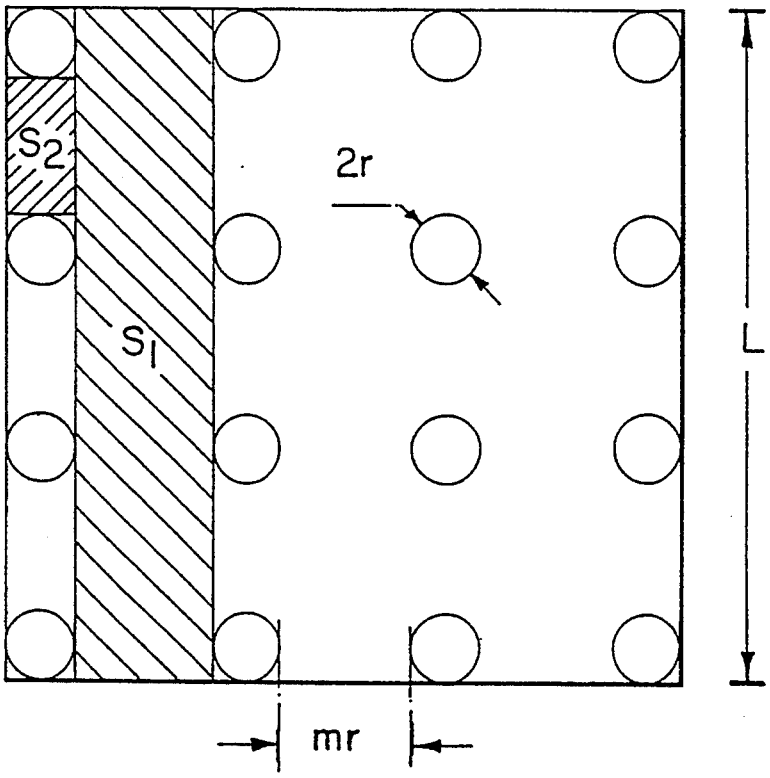
FIG. 12 shows the distribution of scattering centers in FIG. 10.

Now let's consider a square-shaped thin film whose dimensions and the scatterer distribution are shown in FIG. 12. Assuming that there are N scattering centers well distributed in this film, the distance between them is large enough so that we can omit the interaction between them in order to simplify the derivation. As a result, the total energy emitted out is just the sun, nation of the energy reflected by each scatterer.

Van De Hulst pointed out that a mutual distance of 3 times the radius of the particle is a sufficient condition for independence simplification; i.e. to ignore the interaction between the scatterers.

Assuming the incident energy is $E_O$, the area of the surface is $S_O$, the intensity of the incident beam is $E_O/S_O$; we assign it as $I_O$, i.e. $I_O = E_O/S_O$.

Suppose that the $E_O$ is well-distributed, the energy missing the scatteres and passing through the space between the scatters is lost and labelled $E_{Lost}$. Because of finite reflection on surface 1, only the fraction T of $E_O$ will enter the film.

The area of the space between the scatterers is S'

$$S' = (\sqrt{N} - 1)S_1 + \sqrt{N}(\sqrt{N} - 1)S_2$$

where $S_1 = mrL$ $S_2 = mr^2$

From FIG. 12, $$L = 2r\sqrt{N} + mr(\sqrt{N} - 1)$$

Since $N >> 1$, the above equation can be simplified as $$L = 2r\sqrt{N} + mr\sqrt{N} \text{ i.e. } L^2 = N(m+2)^2r^2$$

$$\therefore N = \frac{L^2}{(m+2)^2r^2} \text{ i.e. } \sqrt{N} = \frac{L}{(m+2)r}$$

Substituting and with $N^{\frac{1}{2}} \approx N^{\frac{1}{2}} - 1$, $$S^1 = N.m(m+2)r^2 + N.2mr^2 = N.m(m+4)r^2$$

The area of the top surface of the thin film:

$$S = L^2 = (2r\sqrt{N} + mr\sqrt{N})^2 = Nr^2(m+2)^2$$

$$\therefore E_{lost} = \frac{S'}{S}TE_0 = \frac{4n_2}{(1+n_2)^2} \cdot \frac{m^2+4m}{m^2+4m+4}E_0$$

Obviously, it is independent from N. If $E_O$ is fixed, $E_{Lost}$ is a function of the refractive index of the film and the parameter m which is shown in FIG. 12.

The incident optical enegery on the scatterers is $$E_{scatter} = T E_0 - E_{lost}$$
$$= T E_0 - \frac{S'}{S} T E_0 = \frac{4T}{m^2 + 4m + 4} E_0$$

Furthermore, we are goin to calculate the energy that is totally reflected by the surfaces 1 and 2 after being reflected by the scatterers; the latter is call $E_{TR}$.

Figure 13:
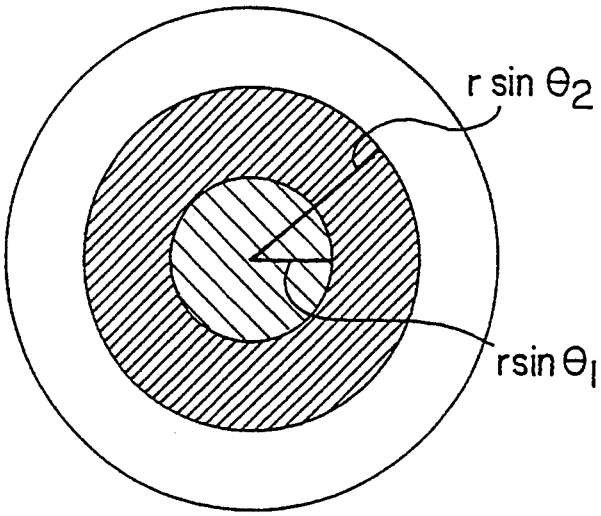
FIG. 13 is a top view of the sphere scatterer.

From the top view of the sphere (FIG. 13)

$$E_{TR} = \frac{\text{Area of the Ring Zone}}{\text{Area of the Round}} \cdot E_{scatter}$$
$$= \frac{\pi(r\sin\theta_2)^2 - \pi(r\sin\theta_1)^2}{\pi r^2} \cdot E_{scatter}$$
$$= (\sin^2\theta_2 - \sin^2\theta_1) \cdot E_{scatter}$$
$$= (\cos^2\theta_1 - \sin^2\theta_1) \cdot E_{scatter}$$
$$E_{TR} = \cos 2\theta_1 \frac{4T}{(m+2)^2} E_0$$

Finally, the intensity of the output light beam $$I = \frac{T^2 \cdot E_{TR}}{4Ld} = \cos 2\theta_1 \cdot \frac{T^2}{(m+2)^2} \cdot \frac{E_0}{Ld}$$

Since the incident light beam intensity is $$I_0 = \frac{E_0}{L^2}$$

The ratio of I and $I_O$ is $$K = \frac{I}{I_0} = \frac{L}{d} \cos 2\theta_1 \cdot \frac{T^2}{(m+2)^2}$$
$$= \frac{4n_2^2}{(1+n_2)^2} \cdot \frac{L}{d} \cdot \frac{\cos 2\theta_1}{(m+2)^2}$$

Figure 14:
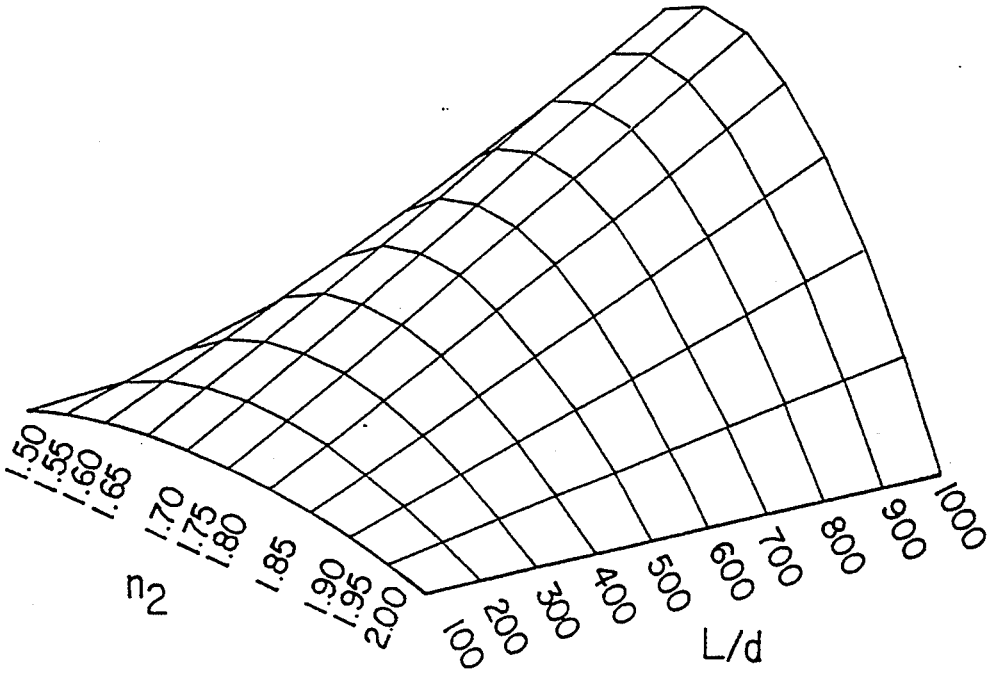
FIG. 14 shows the graphical representation of the light intensification factor K dependence on $n_2$ and L/d.

From the above expression it is clear that K is proportional to L/d, but the relation between K and the refractive index $n_2$ is implicit. It is easier to solve this problem numerically. Typically choosing the values of L/d in the range of 100 to 1000, at $n_2$ equal to 1.7, K will be maximum; $\theta_1$ is 0.314 (tad) which is equivalent to 18°. FIG. 14 gives the variation of K as a function of L/d and $n_2$.

From FIG. 14, it is easy to tell that when $n_2 = 1.7$, L/d=1000, K reaches its maximum which is 7.04. Clearly K will reach higher values for higher values of L/d.

4. Multilayered Implementation

In a particular embodiment of this invention it is found beneficial to break the second layer of a nominal two layer system as prescribed in section I above, into multiple sublayers such that individual sublayers are obtained utilizing one of the techniques disclosed in sections I, II and III. The composite structure will exhibit a characteristic which is the product of the transfer functions of the stack of different sublayers and allows the multilayer composite system to conveniently take advantage of the characteristics provided by the above disclosed different techniques.

III. The Spatial-Distribution of the Applied Coating

Another important element of this invention is to prescribe the variable spectral characteristic coating obtained utilizing one or more of the considerations described in section I and II, and which constitutes the second layer of the structure described in FIG. 4 of section I as a two layer system to be laid on the original paper or other document substrate in a spatially non-uniform manner. This second layer is prescribed to be laid down, by one of the standard methods of printing or coating, non-uniformly corresponding to a 100% density modulation, with a single or multiple one dimensional or two dimensional spatial Fourier frequency similar to the prescription of European Patent application 90909606.1. This is a preferred feature of the invention. The spatial modulation of the density will render this technique highly successful in the anti-photocopying art, because it allows a very wide dynamic range in the variable spectral characteristic of the top optically active layer.

Specifically, with respect to the embodiment of the thin film light intensifier, the photochromic dye can be applied to a paper substrate in accordance with the scrawling pattern disclosed in copending application PCTCA9000203 filed Jun. 29, 1990.

Figure 15:
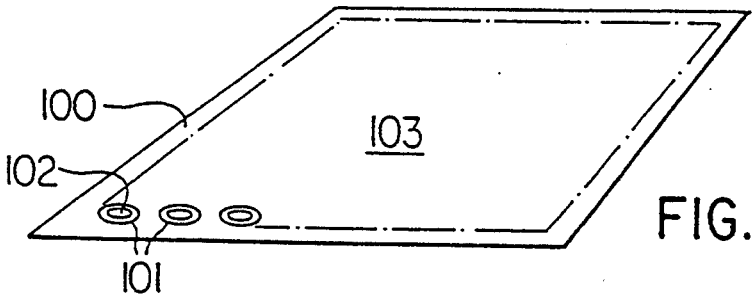
FIG. 15 is a top view of another embodiment of the invention.
Figure 16:
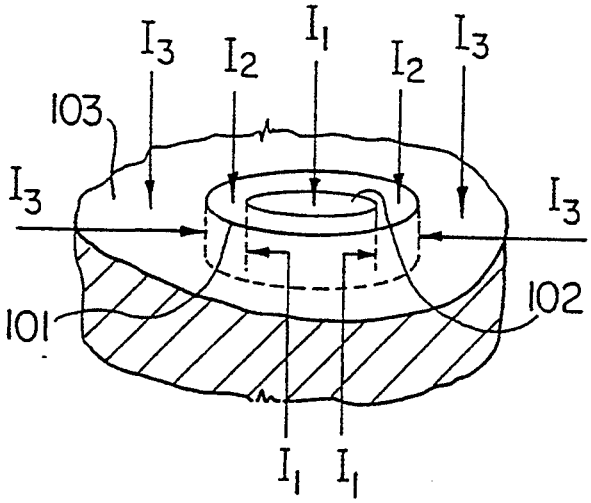
FIG. 16 is a detail of the embodiment of FIG. 15.

As shown in FIG. 15, the dye is printed on substrate 100 in the form of doughnut shapes 101 which correspond to the circles in the aforementioned scrawling pattern. The TFLI is coated thereover, filling in the center 102 of each doughnut shape and filling in thereround at 103. As a result, as shown in FIG. 16, light $I_1$ falling in area 101 will be directed to the dye, light $I_3$ falling in area 103 will be directed to the dyeand-light $I_2$ will add to the light $I_1$ and $I_3$.

It is important to note that a basic feature of this invention is the ability to switch off the scrambling effect of the spatial density modulation when the document is not subject to photocopying, and therefore, the readability of the document is not degraded when the photochormic system is in its switched off state. Actually when the bottom layer of the two layer structure introduced in section I, is made to have a light or even white color, the antiphotocopying paper can actually appear to be almost a white paper.

The present disclosure describes an invention for a novel anti-photocopying and anti-telefaxing technique which provides the possibility of manufacturing an interactive uncopiable paper or document, the uncopiability of which is switched on and off in the process of attempting to photocopy such a document. Furthermore, the invention decouples the uncopiability feature of the document from its readability, and the latter can thus be strongly enhanced.

One advantage of the invention is that a document in accordance with the invention can easily be distinguished from a counterfeit document not in accordance with the invention because the counterfeiting techniques are normally incapable of transferring the optical activity effect. Hence, the counterfeit document will not respond to a photochromic test as does the genuine original. The invention thus has an antifraud application.

Other embodiments of the invention will be readily apparent to a person skilled in the art.

What is claimed is:

1. A method of preventing reproduction of printed matter on a substrate by photocopying and telefaxing wherein an intense amount of light is used, comprising the steps of:

providing a substrate with at least one surface;

applying a photochromic dye to the at least one surface, wherein the dye changes color in response to exposure to light with a response time which is a function of the amount of light absorbed by the dye in a given time period;

illuminating the at least one surface with an intense amount of light; and applying an optical element to at least one of the dye and the at least one surface to decrease the response time of the dye and accelerate the change in color of the dye, wherein the optical element increases the proportion of the intense amount of light which is absorbed by the dye.

2. The method according to claim 1, wherein the step applying the photochromic dye comprises encapsulating the dye in transparent spherical capsules and coating the at least one surface with the capsules and wherein the step of applying the optical element comprises covering less than the entire surface of the spherical capsules on a portion facing away from the at least one surface with a reflective coating.

3. The method according to claim 2, wherein the step of encapsulating comprises encapsulating the dye with a liquid solvent which decreases the response time.

4. The method according to claim 2, wherein the step of applying the optical element comprises disposing the dye in a Fabry-Perot structure including an at least partially reflective surface adjacent the at least one surface and a partial reflective surface with the dye therebetween.

5. The method according to claim 1, wherein the step of applying an optical element comprises applying a thin film light intensifier to the at least one surface to direct light incident thereon to the dye in a direction parallel to the at least one surface and with an increased intensity.

6. A substrate for preventing reproduction of printed matter thereon by photocopying and telefaxing with an intense amount of light, comprising:

at least one surface;

a photochromic dye applied to the at least one surface, wherein the dye changes color in response to exposure to light with a response time which is a function of the amount of light absorbed by the dye in a given time period; and an optical element applied to at least one of the photochromic dye and the at least one surface and increasing the proportion of light from an illumination by an intense amount of light which is absorbed by the dye to decrease the response time of the dye in response to the illumination of the at least one surface with the intense amount of light to accelerate the change in color of the dye and thereby prevent reproduction of information on the at least one surface.

7. The substrate according to claim 6, comprising a planar transparent member and wherein the photochromic dye comprises dye encapsulated in transparent spherical capsules and coated on one surface of the planar member and wherein the optical element comprises a reflective coating over less than the entire surface of the spherical capsules on a portion facing away from the one surface of the planar memeber.

8. The substrate according to claim 7, wherein the dye is encapsulated with a liquid solvent which decreases the response time.

9. The substrate according to claim 6, wherein the optical element comprises a Fabry-Perot structure including an at least partially reflective surface adjacent the at least one surface and a partial reflective surface with the dye disposed therebetween.

10. The substrate according to claim 6, wherein the optical element comprises a thin film light intensifier applied to the at least one surface to direct light incident thereon to the dye in a direction parallel to the at least one surface and with an increased intensity.

* * * * *